United States Patent [19]

Van Laar et al.

[11] Patent Number: 4,565,525

[45] Date of Patent: Jan. 21, 1986

[54] TAPHOLE CONSTRUCTION OF A SHAFT FURNACE

[75] Inventors: Jacobus Van Laar, Santpoort; Jacob Felthuis, Oudorp; Jahannes A.M. Butter, Uitgeest; Jacob Rengersen, Sint-Pancras; Albert Sannes, Broek op Langedijk, all of Netherlands

[73] Assignee: Hoogovens Groep B.V., IJmuiden, Netherlands

[21] Appl. No.: 612,430

[22] Filed: May 21, 1984

[30] Foreign Application Priority Data

May 26, 1983 [NL] Netherlands ..... 8301862

[51] Int. Cl.[4] ..... F27B 14/08

[52] U.S. Cl. ..... 432/248; 432/252; 432/250; 266/196; 266/197

[58] Field of Search ..... 266/196, 197; 432/248, 432/250, 252, 161

[56] References Cited

U.S. PATENT DOCUMENTS

| | | | |
|---|---|---|---|
| 1,995,941 | 3/1935 | Pugh | 266/196 |
| 2,206,944 | 7/1940 | Danforth, Jr. | 432/248 |
| 2,293,332 | 8/1942 | Dow et al. | 432/252 |
| 3,190,626 | 6/1965 | Schwabe et al. | 432/248 |
| 3,752,638 | 8/1973 | Van Laar et al. | 432/252 |
| 4,371,334 | 2/1983 | Van Laar | 432/252 |

FOREIGN PATENT DOCUMENTS

| | | |
|---|---|---|
| 7312549 | 3/1975 | Netherlands . |
| 1585155 | 2/1981 | United Kingdom . |
| 2083896 | 3/1982 | United Kingdom . |

*Primary Examiner*—Henry C. Yuen

*Attorney, Agent, or Firm*—Stevens, Davis, Miller & Mosher

[57] ABSTRACT

In a shaft furnace having a metal shell, a refractory furnace lining inside the shell and a taphole construction comprising a drilled taphole extending through a plug located in an aperture in the shell and a taphole brick structure forming part of said furnace lining, the taphole brick structure at least partly consists of at least one taphole brick of high thermal conductivity material selected from the group comprising graphite, semi-graphite and material of equivalent heat conductivity, there further being screening means comprising material of substantially lower heat conductivity coefficient than graphite and semi-graphite located between said taphole brick and said furnace shell.

11 Claims, 3 Drawing Figures

TAPHOLE CONSTRUCTION OF A SHAFT FURNACE

BACKGROUND OF THE INVENTION

1. Field of the Invention

The invention relates to a shaft furnace e.g. a blast furnace, having a metal shell, a refractory furnace lining inside the shell and a taphole construction comprising an aperture in the furnace shell and a refractory plug located in the aperture, a drilled taphole extending through the plug and the lining.

2. Description of the Prior Art

A taphole construction as described above is conventional in the blast furnaces for the production of molten iron, although, in principle, it can also be used for other types of metallurgical furnaces. The shape of the aperture in the furnace shell (also called armour) may vary, depending on the structure of the furnace itself. As a rule, the entire taphole construction is of larger design for larger blast furnaces with a larger tapping capacity. Often, the shape of the aperture in the furnace shell is generally rectangular or is rectangular with an arch-shaped curve at the top. In the practice of the present invention, no specific shape is, however, essential. Usual dimensions of the width and the height of the aperture respectively vary between 40 and 60 cm for the width and 80 and 120 cm for the height. As a rule, the armour plate of the metal shell at the location of the aperture is provided with a collar, projecting to the outside, in which a plug is installed. In many constructions, the taphole is drilled so as to slope downwards from the outside inwardly for practical reasons.

Blast furnaces are operated under overpressure, which means that they can be tapped only periodically. To effect a tapping, the taphole is opened. Subsequently the taphole is closed again after tapping has been completed by inserting a hardened taphole mass e.g. clay into the hole. This mass has to be drilled, burned or pushed out for a subsequent tapping. Such taphole masses, therefore usually consist of a refractory component and a hardening binder component. During filling of the taphole opening, the temperature of the taphole wall is of importance. For, if this temperature is too high, the danger exists that volatile components in the binder evaporate almost explosively, and hamper closing of the hole. If, on the other hand, the temperature of the taphole is too low, the binder does not harden fast enough resulting in loss of operating time of the furnace or danger of opening of the taphole prematurely. As a rule, therefore, it is sought that the temperature of the taphole wall during operation, i.e. after several tappings, adopts a value within a temperature range of 500° C.–800° C.

With an embodiment of the taphole construction in which the refractory bricks, as is usual, consist of chamotte or equivalent material, after some time the problem of cracking in the taphole is experienced, or of crumbling of the taphole brick. This is caused by the strong fluctuations in temperature during and after tapping and the only limited resistance of the material used to temperature fluctuations. As the taphole brick in most constructions is situated partly behind the furnace shell, replacement of a defective taphole brick is not possible other than during a major repair of the furnace. Therefore, efforts have been made to achieve interim repairs of defect taphole bricks but, in practice, these also create problems.

Earlier efforts made at the plant of the assignees of the present inventors to manufacture taphole bricks from material with higher resistance to temperature fluctuations have not led to a solution, because these materials, such as graphite, as a rule possess a much higher heat conductivity. Consequently, very intensive cooling of the taphole brick takes place from the furnace shell or from the surrounding furnace lining, which causes problems in the hardening of the taphole mass.

SUMMARY OF THE INVENTION

An object of the invention is to provide a taphole construction for a blast furnace in which the difficulties described above are reduced or avoided, so that a taphole construction resistant to temperature fluctuations and which maintains a suitable temperature for closing is obtained.

The present invention consists in that a least one refractory taphole brick in the furnace lining at the location where the taphole runs through it, consists of graphite, semigraphite or a material of equivalent heat conductivity, and that this (these) graphite or semigraphite brick(s) is (are) screened from the furnace shell by refractory material with a substantially lower heat conductivity coefficient $\lambda$. Where, in this description and claims, there is reference to a heat conductivity coefficient $\lambda$, this is expressed in the dimensions Kcal/m°Ch. For information, the following values of $\lambda$ for various materials are given, with the warning, however, that, depending on the quality of the materials, rather large variations may appear:

graphite—$\lambda=90$–100
chamotte—$\lambda=1$–2
carbon—$\lambda=4$–12
semigraphite—$\lambda=12$–30

A material equivalent to graphite or semigraphite in respect of heat conductivity is herein taken to be a material with a $\lambda$-value of between 12 and 100. Furthermore, in this description and claims, by semigraphite is understood a material containing carbon and graphite with a $\lambda$-value in the range 12–30.

By screening the highly-conductive graphite or semigraphite thermally by a refractory material with a considerably lower heat conductivity coefficient $\lambda$, the heat flow from the graphite or semigraphite brick is greatly limited so that the temperature of the graphite or semigraphite brick is more influenced by the heat it receives, during each tapping from the molten iron flowing through it. By an appropriate choice of the screening layer, depending on the rest of the furnace construction and the tapping frequency, it is in this way possible to keep the taphole wall within the desired temperature range of 500°–800° C.

With the new construction according to the invention, it is possible to keep the taphole brick(s) undamaged for a practically unlimited period, while achieving controlled rapid hardening of the taphole mass. By this method, the occurrence of gas leakage from the furnace through the brick to the outside is considerably reduced. This gas leakage can be excluded completely by screening the taphole construction, including the material screening the taphole brick(s) from the furnace shell, from the rest of the furnace lining by a metal casing which is connected gas-tightly to the furnace shell. This gas-tight connection can be made by means of welding, adhesion or soldering. The metal casing may itself consist of for example an alloyed steel plate or copper plate.

BRIEF DESCRIPTION OF THE DRAWINGS

Preferred embodiments of the invention will now be described by way of non-limitative example with reference to the accompanying drawings, in which.

DESCRIPTION OF THE PREFERRED EMBODIMENTS

Figure 1:
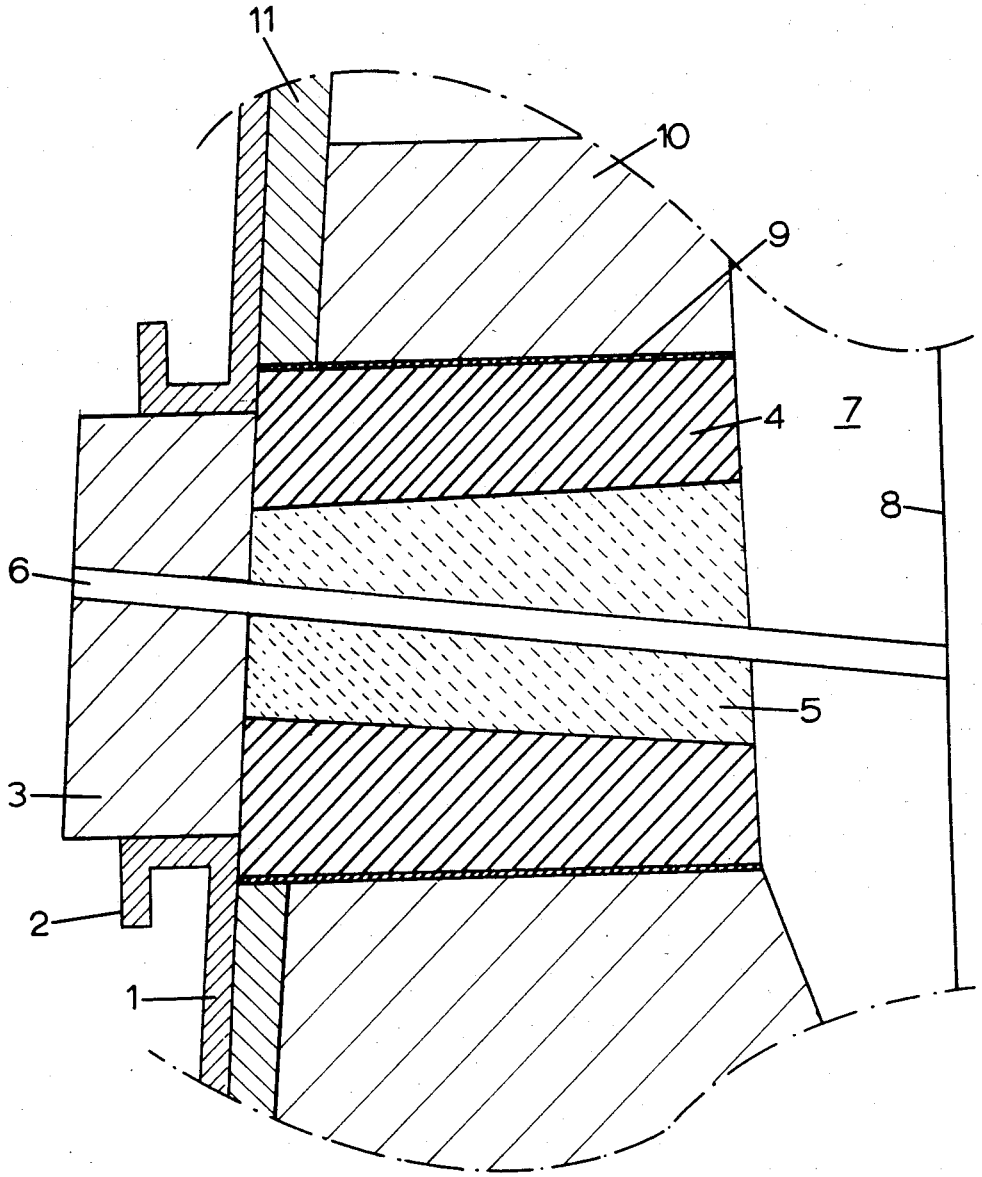
FIG. 1 shows, in longitudinal vertical section, a first taphole construction embodying the invention.

FIG. 1 shows the steel shell 1 of a blast furnace which has an aperture at the location of the taphole. At the edge of this aperture, the shell has a collar extending outwardly and ending in a flange 2. Within this collar of the furnace shell 1, a refractory plug 3 is located.

The taphole brick structure proper in this embodiment consists of a carbon block 4 and a taphole brick in the form of a graphite plug 5. The graphite plug 5 is shaped to fit in a conical hole in the carbon block 4. A taphole 6 is drilled through the plug 3, the graphite plug 5 and the interior lining 7 of the furnace inside it to the inside face 8 of the lining.

The carbon block 4 is surrounded by a copper mantle 9 which is gas-tightly connected to the shell 1. Outside the mantle 9, against the furnace shell 1, a layer of ramming mass 11 is applied. Within the mass 11, a lining of bricks 10 is erected, which connects with the interior protective layer 7. Thus the highly conductive graphite plug 5 is screened from the shell 1 by the less conductive material of the block 4.

Since the taphole 6 in the taphole brick extends in the taphole brick structure, entirely through graphite, it has, as a result of the very high heat conductivity of graphite, a practically even temperature over its entire length. Over the entire length of the taphole 6 in the taphole brick 5 hardening of the taphole mass will, therefore, take place practically at the same time. As the hole in the carbon block 4 widens towards the interior of the furnace, the graphite brick 5 is kept in its place in the carbon block 4 by the overpressure in the furnace. The hole in the carbon block 4 may taper conically as shown, or stepwise. Especially in the latter case, it is conceivable to divide the graphite brick 5 and the carbon block 4 into two or three separate elements in the longitudinal direction of the taphole. The brick 5 may be of semigraphite, instead of graphite. If the hole in the carbon block 4 is stepped, the core of graphite or semigraphite is then provided with a thickened rim that extends to behind the shell and, if the rim consists of graphite is insulated from it.

A reverse construction is also feasible in which the taphole brick structure consists of a graphite block with a continuous hole through it widening towards the interior of the furnace, in which hole a chamotte block fits, and with the graphite block insulated from the furnace shell.

In a typical practical example of the taphole of FIG. 1, the following dimensions apply, although these can be chosen differently for other embodiments:

diameter taphole—approx. 100 mm
length taphole—approx. 1700 mm
height and width of the aperture in the shell 1—approx. 1000 mm and 800 mm
length of the plug 3—500 mm For the embodiments of FIGS. 2 to 4, the differences from that of FIG. 1 will be described, the other parts shown in the Figures being taken to be the same.

Figure 2:
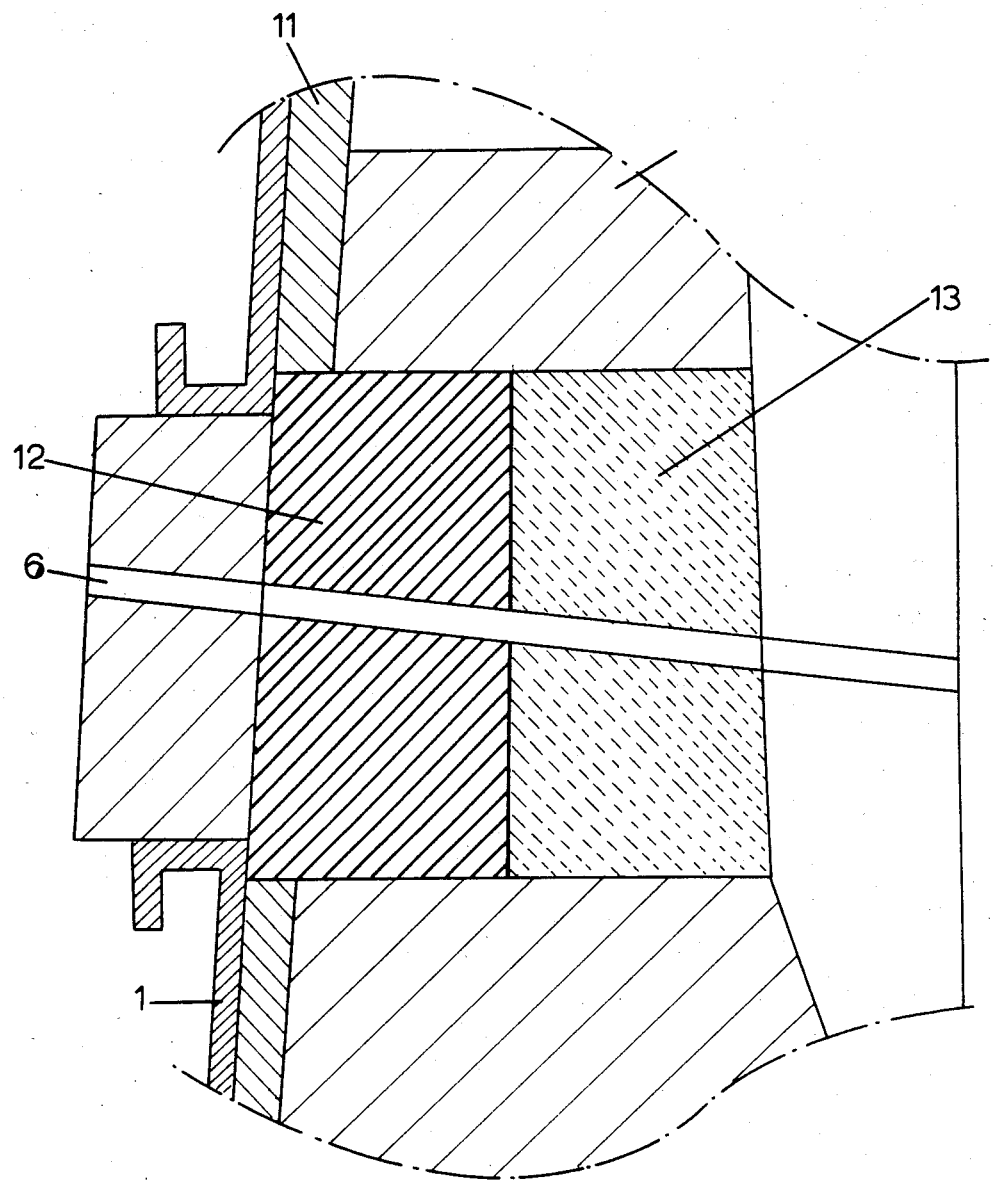
FIGS. 2 and 3 show in vertical section further taphole constructions in two other embodiments of the invention, respectively.

In FIG. 2, an embodiment is shown in which, instead of the carbon block 4 and the graphite plug 5 of FIG. 1, a carbon taphole block 12 and a graphite taphole block 13 are arranged in that sequence from the outside inward. The graphite block 13 may alternatively be of semigraphite. In this embodiment, the graphite block 13 on the inside of the taphole construction is kept at the desired temperature because the carbon block 12 shields it thermally from the furnace shell 1. In this case, no separate insulation layer of chamotte or equivalent material is necessary (compare FIG. 3), while the carbon block 12, because of its better heat conductivity than that of chamotte, can be designed thicker than the chamotte layer of FIG. 3. As in this case the carbon brick 12 is installed at the outside of the lining, it remains at a lower average temperature than the graphite brick. Further, carbon also has a fair resistance to temperature fluctuations and, in this construction, does not involve a risk of cracking or crumbling.

Figure 3:
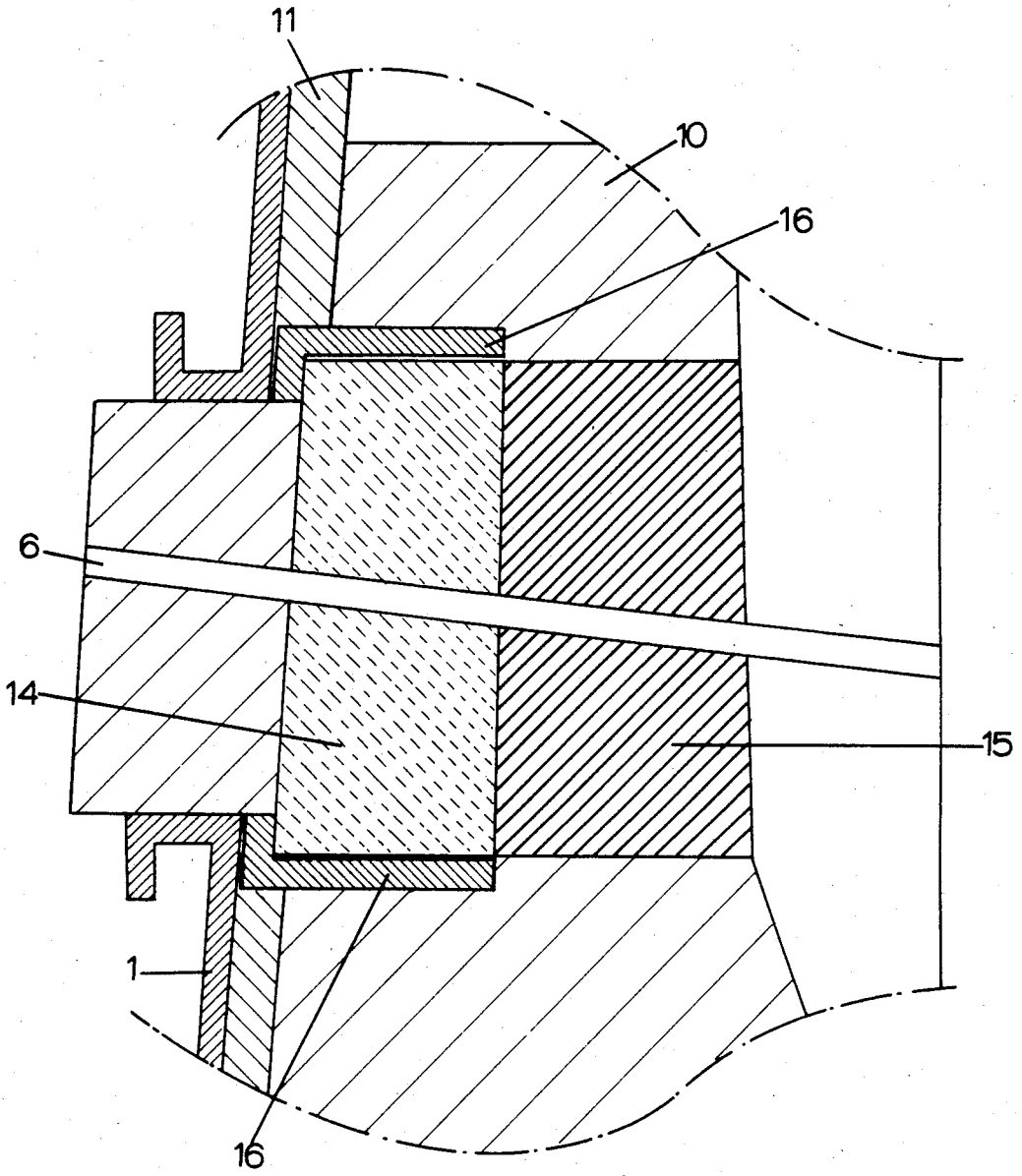

In the embodiment of FIG. 3, a graphite taphole block 14 is situated closer to the furnace shell 1 and a carbon taphole block 15 interiorly thereof on the fire side of the taphole brick construction. In order to insulate the outer part of the construction, in this case the graphite block 14, thermally from furnace shell 1 and the lining elements 10 and 11, a chamotte layer 16 is arranged between the block 14 and these parts 1,10,11.

The graphite block 14 may alternatively be of semigraphite and the carbon block 15 alternatively of chamotte. In the embodiment of FIG. 3, because the carbon or chamotte block 15 is located towards the inside of the furnace, it remains at such a high temperature that the temperature fluctuations therein are slight and there is no danger of cracking or crumbling. The largest temperature fluctuations take place at the outside of the graphite or semigraphite brick 14, which, however, is resistant to these fluctuations. The brick 14 itself is kept at a suitable temperature by the insulation between it and the furnace shell 1 and the surrounding furnace lining 10,11 provided by a low-conductivity chamotte layer.

We claim:

1. A blast furnace having a metal shell, a refractory furnace lining inside the shell and a taphole construction comprising (a) an aperture in the shell
(b) a plug located in said aperture
(c) a taphole brick structure comprising at least one taphole brick forming part of said furnace lining, with a drilled taphole extending through said plug and said taphole brick structure,
wherein said taphole brick structure at least partly consists of at least one taphole brick surrounding the taphole having a heat conductivity coefficient of from 12 to 100 Kcal/m°Ch and a material having a heat conductivity coefficient below 12 Kcal/m°Ch located between said taphole brick and said furnace shell.

2. A furnace according to claim 1 wherein said screening means comprises at least one taphole brick.

3. A furnace according to claim 1 including a metal shell which is closed gas-tightly to the furnace shell and screens said taphole brick structure from the surrounding parts of the furnace lining.

4. A furnace according to claim 1, wherein said taphole brick structure comprises a graphite or semigraphite taphole brick and interiorly thereof (with respect to the furnace) a carbon or chamotte taphole brick, said screening means comprises a chamotte layer which also screens the graphite or semi-graphite layer from the surrounding parts of the furnace lining.

5. A furnace according to one of claims 1 and 2 wherein said taphole brick structure comprises a carbon taphole brick and, interiorly thereof (with respect to the furnace), a graphite or semi-graphite taphole brick.

6. A furnace according to claim 1 wherein said taphole brick structure comprises a carbon brick having an aperture extending through it from a face directed towards the outside of the furnace to a face directed towards the inside of the furnace and widening in the direction towards the inside of the furnace and a graphite or semi-graphite taphole brick fitting within said aperture of the carbon brick.

7. A furnace according to claim 1 wherein said taphole brick structure comprises a graphite tubular brick having an aperture extending through it from a face directed towards the outside of the furnace to a face directed towards the inside of the furnace and widening in the direction towards the inside of the furnace and a chamotte taphole brick fitting within said aperture of the graphite brick, said graphite brick being thermally screened from the furnace shell.

8. A furnace according to claim 6 wherein said aperture of said tubular brick tapers conically.

9. A furnace according to one of claims 6 and 7 wherein said aperture of said tubular brick tapers stepwise.

10. A blast furnace having a metal shell, a refractory furnace lining inside the shell and a taphole construction comprising an aperture in the shell, a plug located in said aperture and a taphole brick structure forming a part of said lining with a taphole extending through said plug and said taphole brick structure wherein said taphole brick structure comprises at least one brick made of refractory material selected from the group consisting of graphite and semi-graphite out of contact with said shell, and a refractory material selected from the group consisting of chamotte and carbon positioned in contact with said shell.

11. In a blast furnace having a metal shell, a refractory furnace lining inside the shell and a taphole construction in the hearth of the blast furnace comprising an aperture in the furnace shell with behind it the lining consisting of at least one refractory brick, and in front of it, reaching through the aperture in the furnace shell, a refractory plug, a drilled taphole running through the plug and the lining, the improvement being that at least part of the refractory brick of the lining at the location where the taphole runs through it, consists of graphite, or semi-graphite having a high heat conductivity coefficient and is shielded from the furnace shell by refractory material with a considerably lower heat conductivity coefficient.

* * * * *